US008395470B2

(12) United States Patent
Lin

(10) Patent No.: US 8,395,470 B2
(45) Date of Patent: Mar. 12, 2013

(54) ASYMMETRICAL PLANAR TRANSFORMER HAVING CONTROLLABLE LEAKAGE INDUCTANCE

(76) Inventor: Chih-Hao Lin, Yunlin (TW)

( * ) Notice: Subject to any disclaimer, the term of this patent is extended or adjusted under 35 U.S.C. 154(b) by 0 days.

(21) Appl. No.: 13/191,425

(22) Filed: Jul. 26, 2011

(65) Prior Publication Data

US 2013/0027165 A1 Jan. 31, 2013

(30) Foreign Application Priority Data

Sep. 17, 2010 (TW) ..... 99131574 A

(51) Int. Cl.
*H01F 27/30* (2006.01)

(52) U.S. Cl. ..... 336/199; 336/196; 336/197; 336/198

(58) Field of Classification Search ..... 336/192, 336/195, 196, 197, 198, 199
See application file for complete search history.

(56) References Cited

U.S. PATENT DOCUMENTS

| | | | | |
|---|---|---|---|---|
| 5,331,536 | A * | 7/1994 | Lane | 363/126 |
| 6,522,233 | B1 * | 2/2003 | Kyoso et al. | 336/200 |
| 6,828,894 | B1 * | 12/2004 | Sorger et al. | 336/200 |
| 6,980,077 | B1 * | 12/2005 | Chandrasekaran et al. | 336/212 |
| 7,498,921 | B1 * | 3/2009 | Wang | 336/200 |
| 7,515,026 | B1 * | 4/2009 | Liu et al. | 336/192 |
| 7,538,651 | B2 * | 5/2009 | Hsu et al. | 336/198 |
| 7,701,316 | B2 * | 4/2010 | Teng et al. | 336/131 |
| 7,886,425 | B2 * | 2/2011 | Liu et al. | 29/606 |
| 8,013,709 | B2 * | 9/2011 | Tsai et al. | 336/208 |
| 8,183,968 | B2 * | 5/2012 | Tsai et al. | 336/198 |
| 8,269,593 | B2 * | 9/2012 | Tsai et al. | 336/198 |
| 2008/0180205 | A1 * | 7/2008 | Tsai et al. | 336/192 |
| 2008/0284551 | A1 * | 11/2008 | Chen et al. | 336/182 |

* cited by examiner

*Primary Examiner* — Mohamad Musleh
*Assistant Examiner* — Joselito Baisa
(74) *Attorney, Agent, or Firm* — Alan Kamrath; Kamrath IP Lawfirm, P.A.

(57) ABSTRACT

An asymmetrical planar transformer having controllable leakage inductance is provided. The asymmetrical planar transformer includes a circuit board, a winding rack, a primary winding, a secondary winding, and a magnetic core assembly. Via hole is formed on circuit board. Winding rack includes several annular plates, a tubular shell, and a through hole. The first, second, and third annular plates are arranged in parallel. Position of through hole is corresponding to that of via hole. Primary winding is disposed between first and second annular plates, and is electrically connected with circuit board. Secondary winding, with annular shape, is disposed between second annular plate and third annular plate, and is electrically connected with circuit board. Magnetic core assembly includes magnetic column which is passed through via hole of circuit board and through hole of winding rack. Through hole is extended through secondary winding, first annular plate, second annular plate, and third annular plate.

11 Claims, 4 Drawing Sheets

ASYMMETRICAL PLANAR TRANSFORMER HAVING CONTROLLABLE LEAKAGE INDUCTANCE

FIELD OF INVENTION

The invention relates to a transformer, especially relates to a planar transformer.

BACKGROUND OF THE INVENTION

In the present time, transformers are primarily divided into two main categories. One of these two categories is an asymmetrical winding transformer as shown in Taiwanese patent No. M289515. The other category includes a symmetrical planar transformer as shown in Taiwanese patent publication No. 200839800.

Taiwanese patent No. M289515 discloses a transformer. The transformer includes a first winding rack and a second winding rack. There is a central hole disposed in the center of the first winding rack for containing a central column of an E-shaped magnetic core. A coil is wound around the periphery of the first winding rack. A casing opening having a larger inner diameter is disposed in one end of the first winding rack. There is also a central hole disposed in the center of the first winding rack, for containing a central column of another E-shaped magnetic core. Another coil is wound around the periphery of the second winding rack. One end of the second winding rack is inserted into the casing opening of the first winding rack, so as to form a retractable or telescoping structure. A plurality of conductive pins of the first and second winding rack is disposed on the other side of the retractable structure for connecting with the coils. By sliding the end of the second winding rack in the casing opening of the first winding rack to change the clearance between the two coils, the value of the resonant inductance or leakage inductance can be adjusted.

Taiwanese patent publication No. 200839800 discloses a symmetrical planar transformer. The transformer includes a first circuit board, a second circuit board, and a coil connecting element. The first circuit board has a first coil and a second coil. The second circuit board is disposed corresponding to the first circuit board and has a third coil and a fourth coil. The coil connecting element has a first pin and a second pin. The first pin is connected with the first coil and the second pin is connected with the second coil. The coil connecting element controls the connecting or separation between the first coil and the second coil.

In Taiwanese patent No. M289515, the coil is wound by using traditional winding method. Furthermore, the transformer must have larger volume to permit the second winding frame to slide so that it cannot be manufactured in a compact size. In Taiwanese patent publication No. 200839800, the coils are disposed in the circuit board, so that the transformer cannot be manufactured in a more compact size. Furthermore, a composite magnetic material can be disposed between the first circuit board and the second circuit board. By controlling the thickness of the composite magnetic material, the resonant inductance can be adjusted. However, because of the increasing demand for a more compact electronic device and the increasing cost reduction pressures as experienced by companies, the symmetrical planar transformer is even more difficult to meet the demands of the market.

SUMMARY OF THE INVENTION

One aspect of the invention is to provide an asymmetrical planar transformer having controllable leakage inductance.

The asymmetrical planar transformer has more compact size and improved assembly efficiency.

To achieve the foregoing and other aspects, an asymmetrical planar transformer is provided. The asymmetrical planar transformer includes a circuit board, a winding rack, a primary winding, a secondary winding, and a magnetic core assembly. A via hole is formed on the circuit board. The winding rack includes a first annular plate, a second annular plate, a third annular plate, a tubular shell, and a through hole. The first annular plate, the second annular plate, and the third annular plate are arranged in parallel. In addition, the position of the through hole is corresponding to that of the via hole. The primary winding is disposed between the first annular plate and the second annular plate, and electrically connected with the circuit board. The secondary winding, having an annular shape, is disposed between the second annular plate and the third annular plate, and electrically connected with the circuit board. The magnetic core assembly includes a magnetic core and the magnetic core is penetrating through the via hole of the circuit board and the through hole of the winding rack. The through hole is passed through the secondary winding, the first annular plate, a second annular plate, and the third annular plate.

In the asymmetrical planar transformer, the winding rack further comprises a fourth annular plate. The fourth annular plate is disposed between the second annular plate and the third annular plate. The secondary winding is disposed between the third annular plate and the fourth annular plate. Furthermore, a magnetic annular plate is disposed between the second annular plate and the fourth annular plate.

In the asymmetrical planar transformer, the secondary winding includes a metal annular plate. The metal annular plate includes an annular portion which has a gap, and two pins are disposed on two ends of the gap, respectively. The pins are electrically connected to the circuit board.

In the asymmetrical planar transformer, the secondary winding includes two metal annular plates and an insulating annular plate. Each metal annular plate includes an annular portion which has a gap, and two pins are disposed on two ends of the gap, respectively. The pins are electrically connected to the circuit board, and the insulating annular plate is disposed between the two metal annular plates.

The unbalanced planar transformer further includes a sheet. The extend direction of the sheet is perpendicular to the third annular plate.

In the asymmetrical planar transformer, the top and bottom of the tubular shell are each connected to each of the first annular plate and the second annular plate, respectively. The primary winding is wound on the tubular shell. In addition, the winding rack includes a plurality of wire slots. The wire slots are disposed on the tubular shell and the primary winding is wound on at least one of the wire slots.

In the asymmetrical planar transformer, the primary winding is disposed between the first annular plate and the second annular plate.

In the asymmetrical planar transformer, the winding rack includes two conductive pins and the conductive pins are electrically connected to the circuit board. Two ends of the primary winding are connected to the two conductive pins, respectively.

Because of its asymmetrical structure, the asymmetrical planar transformer of the present invention has a more compact size. Furthermore, the secondary winding is an annular plate, so that the asymmetrical planar transformer can become thinner. Thus, the efficiency of the assembly of the planar transformer is improved.

The above and other aspects, features, and advantages of the present invention will become more apparent from the following detailed description when taken in conjunction with the accompanying drawings.

DETAILED DESCRIPTION OF THE INVENTION

Figure 1:
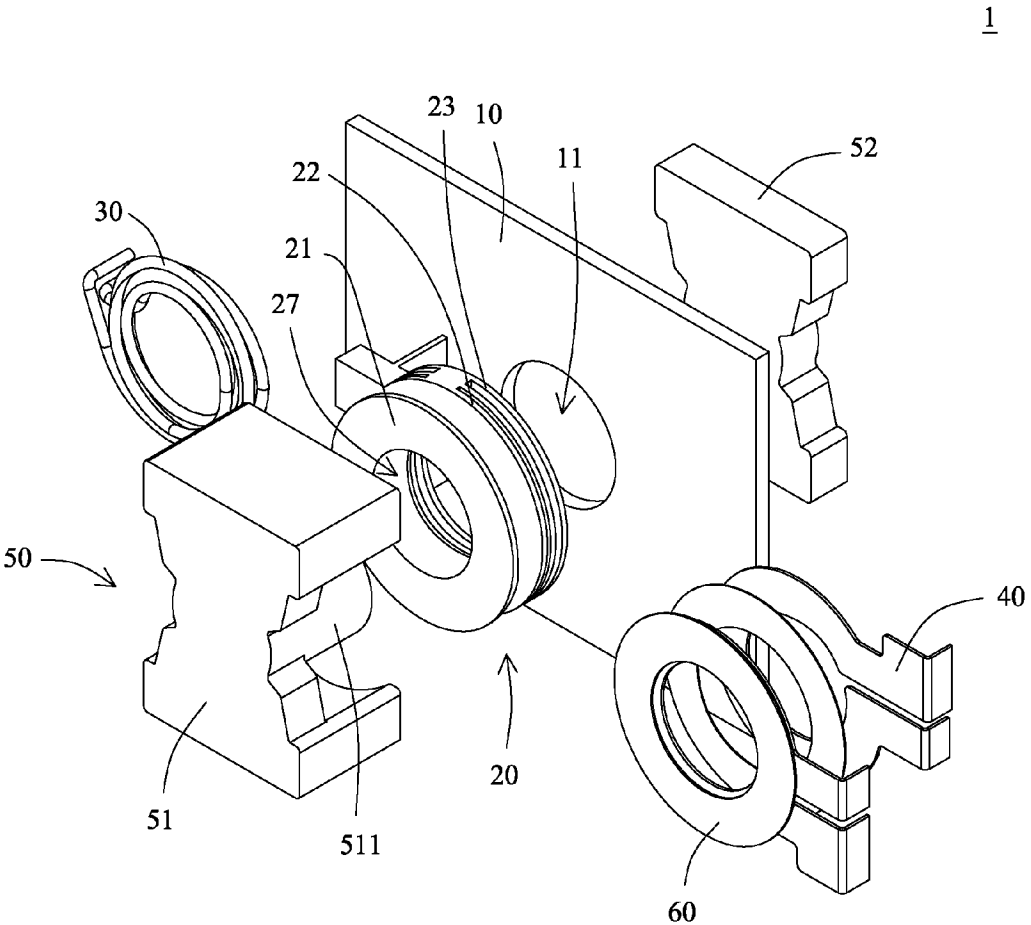
FIG. 1 shows an asymmetrical planar transformer of a first embodiment in the present invention.
Figure 2A:
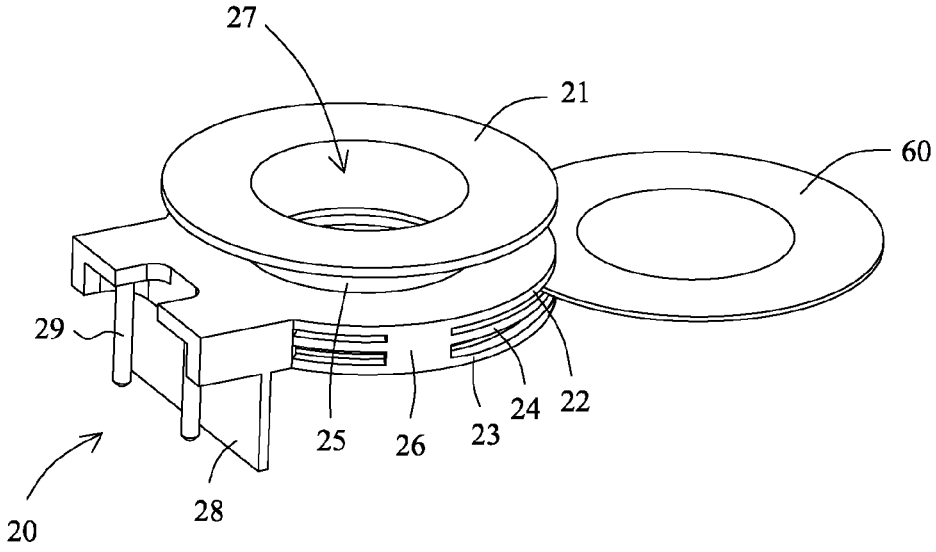
FIG. 2A shows a winding rack of the asymmetrical planar transformer of FIG. 1.

Please refer to FIG. 1 and FIG. 2A. FIG. 1 shows an asymmetrical planar transformer of a first embodiment in the present invention. FIG. 2A shows a winding rack of the asymmetrical planar transformer of FIG. 1. The asymmetrical planar transformer 1 includes a circuit board 10, a winding rack 20, a primary winding 30, a secondary winding 40, and a magnetic core assembly 50. A via hole II is disposed in the circuit board 10. The winding rack 20 includes a first annular plate 21, a second annular plate 22, a third annular plate 23, a fourth annular plate 24, a tubular shell 25, and a through hole 27. The first annular plate 21, the second annular plate 22, the third annular plate 23, and the fourth annular plate are arranged in parallel. The top and bottom of the tubular shell 25 are each connected to each of the first annular plate 21 and the second annular plate 22, respectively. The through hole 27 is passed through the secondary winding 40, the first annular plate 21, the second annular plate 22, and the third annular plate 23. Furthermore, the second annular plate 22, the third annular plate 23, and the fourth annular plate 24 are connected together by a connecting portion 26.

Figure 3:
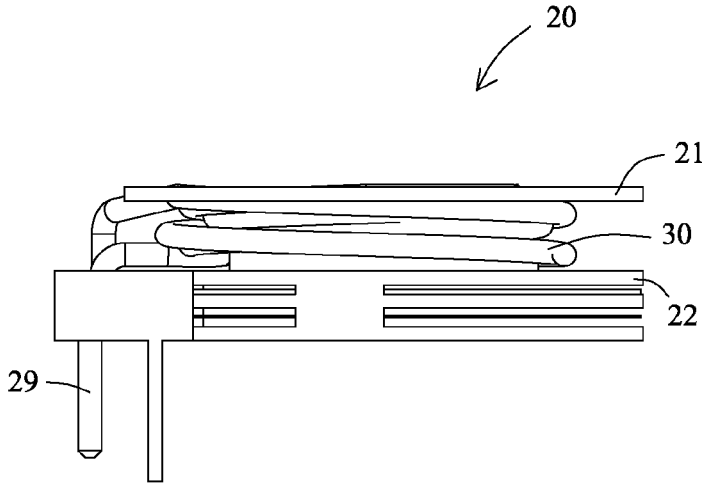
FIG. 3 shows the primary winding winding on the tubular shell.

Please refer to FIG. 1 and FIG. 3. FIG. 3 shows the primary winding 30 winding on the tubular shell 25. The primary winding 30 is wound on the outer surface of the tubular shell 25 and is disposed between the first annular plate 21 and the second annular plate 22. In addition, two ends of the primary winding 30 are connected to two conductive pins 29, respectively. The conductive pins 29 (FIG. 3 shows only one conductive pin 20) are disposed on the winding rack 20, and electrically connected to the circuit board 10.

Figure 4A:
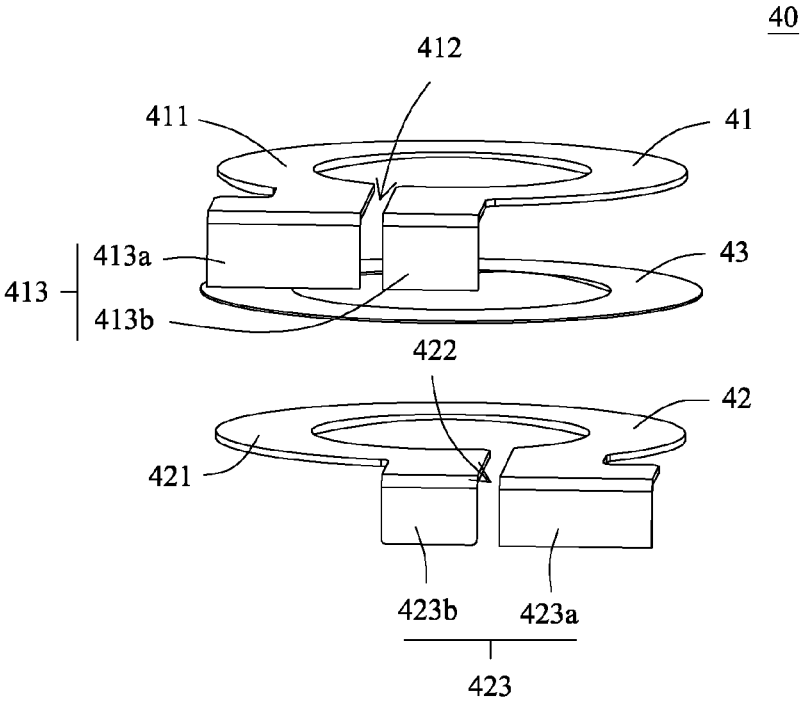
FIG. 4A shows the exploded view of the secondary winding.
Figure 4B:
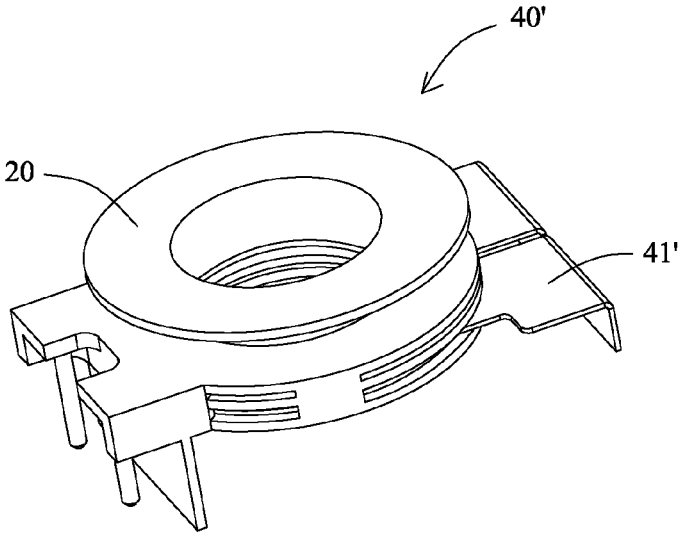
FIG. 4B shows a secondary winding 40' of another embodiment in the present invention.

Please refer to FIG. 1, FIG. 3, and FIG. 4A. FIG. 4A shows the exploded view of the secondary winding 40. The secondary winding 40 has a substantially annular shape and is inserted between the third annular plate 23 and fourth annular plate 24. The secondary winding 40 includes a metal annular plate 41, a metal annular plate 42, and an insulating annular plate 43. The metal annular plate 41 and the metal annular plate 42 have a similar structure. For example, the metal annular plate 41, 42 has an annular portion 411, 421, respectively, and the annular portion 411, 421 has an opening 412, 422, respectively. Two pins 413, 423 are formed on the two ends of the opening 412, 422, respectively. The pins 413, 423 are electrically connected to the circuit board 10. Furthermore, the insulating annular plate 43 is disposed between the metal annular plate 41 and the metal annular plate 42. The metal annular plate 41, 42 is made of, but not limited to, copper.

Please refer to FIG. 4A. The asymmetrical planar transformer 1 is a central tap transformer. The pins 413, 423 includes a leg 413*a*, 423*a* and a leg 413*b*, 423*b*, respectively.

The leg 413*b* is alternately combined and abutted to the leg 423*b*. However, a person of ordinary skill in the art can also separate the leg 413*b* from the leg 423*b*, so as to let the asymmetrical planar transformer 1 to have four legs.

Please refer to FIG. 1. The magnetic core assembly 50 includes a magnetic core 51 and a magnetic core 52. A magnetic column 511 is disposed on the magnetic core 51 and the magnetic core 52 does not have a magnetic column. The magnetic column 511 is passed through the via hole 11 of the circuit board 10 and the through hole 27 of the winding racket 20. Please refer to FIG. 1 and FIG. 2A. The asymmetrical planar transformer 1 further includes a magnetic annular plate 60, and the magnetic annular plate 60 is inserted into the gap between the second annular plate 22 and the fourth annular plate 24. The magnetic annular plate 60, being a thin and flexible film, is a composite of ferrite and polymer . By changing the number and the thickness of the magnetic annular plate 60, the leakage (or resonant) inductance can be adjusted. A person of ordinary skill in the art can select other material to replace the composite of ferrite and polymer depending upon the circumstances. A sheet 28 is disposed on the winding rack 20 and the extend direction of the sheet 28 is perpendicular to the third annular plate 23. In the assembly process, the sheet 28 is inserted into an opening (not shown) of the circuit board 10. The sheet 28 is designed for lengthening the creepage distance and the clearance distance so as to meet safety requirement. Thus the width of the asymmetrical planar transformer 1 can be reduced for saving the occupied space.

Because of the asymmetrical structure, the asymmetrical planar transformer 1 is more compact in size. Furthermore, in this embodiment, the secondary winding 40 is designed to have an annular plate shape, so that the asymmetrical planar transformer 1 can be made more compact, and the assembly efficiency thereof can be improved.

Figure 2B:
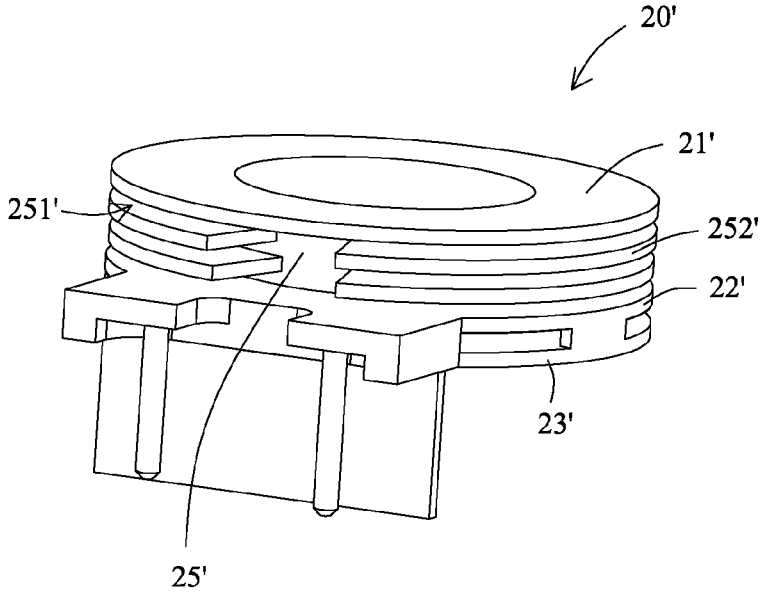
FIG. 2B shows a winding rack of another embodiment in the invention.

Please refer to FIG. 2B. FIG. 2B shows a winding rack 20' of another embodiment in the present invention. The winding rack 20' includes a first annular plate 2 1', a second annular plate 22', and a third annular plate 23'. A plurality of wire slots 251' is disposed on the tubular shell 25'. The wire slots 251' are divided by a plurality of dividing plates 252'. Please refer to FIG. 1 and FIG. 2B simultaneously. The primary winding 30 is wound on one of the wire slots 251' and the secondary winding 40 is inserted into the space between the second annular plate 22' and the third annular plate 23'. A person of ordinary skill in the art can decide upon which one of the wire slots 251' that the primary winding 30 should be wound, so as to control the distance between the primary winding 30 and the secondary winding 40 to adjust the value of the leakage (or resonant) inductance. Because the value of the leakage inductance can be adjusted by changing the position of the winding of the primary winding 30, the magnetic annular plate 60 is therefore not needed. Thus, unlike for the winding rack 20, the fourth annular plate 24' is not disposed in the winding rack 20'.

Figure 2C:
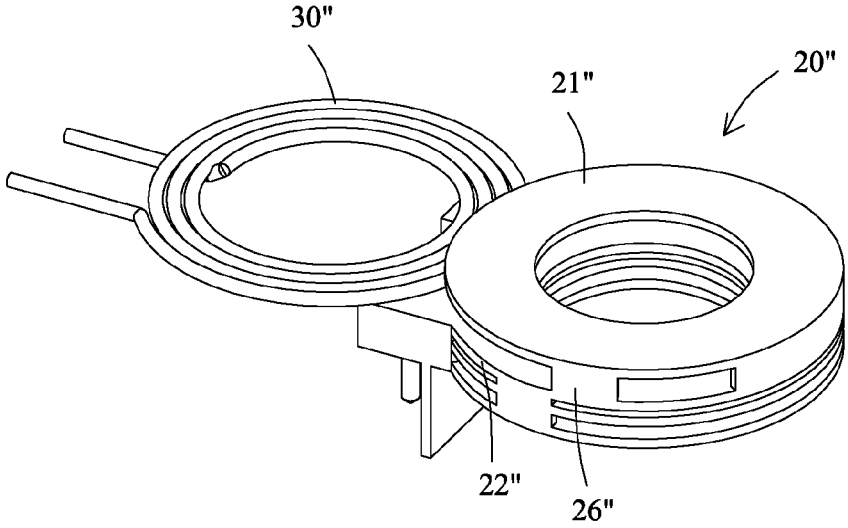
FIG. 2C shows a winding rack of the other embodiment in the invention.

Please refer to FIG. 2C. FIG. 2C shows a winding rack of the other embodiment in the invention. In this embodiment, the difference between the winding rack 20" and the winding rack 20 is that no tubular shell is disposed on the winding rack 20", and a first annular plate 21" and a second annular plate 22" are connected together by the connecting portion 26". A primary winding 30" is wound in advance and inserted into the space between the first annular plate 21" and the second annular plate 22". Therefore, the assembly efficiency thereof can be improved.

In the above described embodiment, the secondary winding 40 is a metal annular plate. However, a person of ordinary skill in the art can opt to design the secondary winding as other types, for example: a coil that is formed on the circuit board.

In the above described asymmetrical planar transformer, because of the asymmetrical structure, the leakage inductance of the transforming circuit operating in the positive half period is different from that in the negative half period, i.e. the energy transmitted in the positive half-period is different from that in the negative half-period. The issue can be resolved by the optimization of the control circuit. For example, the asymmetrical duty cycle can be adjusted by matching with various different dead times. Of course, a person of ordinary skill in the art can decide whether to choose other compensation method or not to use any compensation method.

Although the description above contains many specifics, these are merely provided to illustrate the invention and should not be construed as limitations of the invention's scope. Thus it will be apparent to those skilled, in the art that various modifications and variations can be made in the system and processes of the present invention without departing from the spirit or scope of the invention.

What is claimed is:

1. An asymmetrical planar transformer, comprising:

a circuit board, the circuit board forming a via hole;

a winding rack, the winding rack comprising a first annular plate, a second annular plate, a third annular plate, a tubular shell, and a through hole;

a primary winding, the primary winding disposed between the first annular plate and the second annular plate, and the primary winding electrically connected with the circuit board;

a secondary winding, the secondary winding having an annular shape and disposed between the second annular plate and the third annular plate, the secondary winding electrically connected with the circuit board; and a magnetic core assembly, comprising a magnetic core;

wherein the magnetic core is penetrating through the via hole of the circuit board and the through hole of the winding rack, and the through hole is passed through the secondary winding, the first annular plate, the second annular plate, and the third annular plate, wherein the first annular plate, the second annular plate, and the third annular plate are arranged in parallel, the position of the through hole is corresponding to that of the via hole, the winding rack further comprises a fourth annular plate and at least one magnetic annular plate, and the magnetic annular plate is disposed between the second annular plate and the fourth annular plate.

2. The asymmetrical planar transformer of claim 1, wherein the fourth annular plate and the third annular plate are arranged in parallel, the fourth annular plate is disposed between the second annular plate and the third annular plate, and the secondary winding is disposed between the third annular plate and the fourth annular plate.

3. The asymmetrical planar transformer of claim 1, wherein the secondary winding comprises a metal annular plate, the metal annular plate comprises an annular portion which has a gap, two pins are disposed on two ends of the gap, respectively, and the pins are electrically connected to the circuit board.

4. The asymmetrical planar transformer of claim 1, wherein the secondary winding comprises two metal annular plates and an insulating annular plate, each metal annular plate comprises an annular portion which has a gap, two pins are disposed on two ends of the gap, respectively, the pins are electrically connected to the circuit board, and the insulating annular plate is disposed between the two metal annular plates.

5. The asymmetrical planar transformer of claim 1, further comprising a sheet, wherein the extend direction of the sheet is perpendicular to the third annular plate.

6. The asymmetrical planar transformer of claim 1, wherein the top and bottom of the tubular shell are each connected to each of the first annular plate and the second annular plate, respectively, and the primary winding is wound on the tubular shell.

7. The asymmetrical planar transformer of claim 1, wherein the winding rack comprises a plurality of wire slots, the wire slots are disposed on the tubular shell, and the primary winding is wound on at least one of the wire slots.

8. The asymmetrical planar transformer of claim 1, wherein the primary winding is disposed between the first annular plate and the second annular plate.

9. The asymmetrical planar transformer of claim 1, wherein the winding rack comprises two conductive pins, the conductive pins are electrically connected to the circuit board, and two ends of the primary winding are connected to the two conductive pins, respectively.

10. An asymmetrical planar transformer, comprising:

a circuit board, the circuit board forming a via hole;

a winding rack, the winding rack comprising a first annular plate, a second annular plate, a third annular plate, a tubular shell, and a through hole;

a primary winding, the primary winding disposed between the first annular plate and the second annular plate, and the primary winding electrically connected with the circuit board;

a secondary winding, the secondary winding having an annular shape and disposed between the second annular plate and the third annular plate, the secondary winding electrically connected with the circuit board; and a magnetic core assembly, comprising a magnetic core;

wherein the magnetic core is penetrating through the via hole of the circuit board and the through hole of the winding rack, and the through hole is passed through the secondary winding, the first annular plate, the second annular plate, and the third annular plate, wherein the first annular plate, the second annular plate, and the third annular plate are arranged in parallel, the position of the through hole is corresponding to that of the via hole, the winding rack comprises a fourth annular plate, the fourth annular plate and the third annular plate are arranged in parallel, the fourth annular plate is disposed between the second annular plate and the third annular plate, and the secondary winding is disposed between the third annular plate and the fourth annular plate.

11. An asymmetrical planar transformer, comprising:

a circuit board, the circuit board forming a via hole;

a winding rack, the winding rack comprising a first annular plate, a second annular plate, a third annular plate, a tubular shell, and a through hole;

a primary winding, the primary winding disposed between the first annular plate and the second annular plate, and the primary winding electrically connected with the circuit board;

a secondary winding, the secondary winding having an annular shape and disposed between the second annular plate and the third annular plate, the secondary winding electrically connected with the circuit board; and a magnetic core assembly, comprising a magnetic core;

wherein the magnetic core is penetrating through the via hole of the circuit board and the through hole of the winding rack, and the through hole is passed through the secondary winding, the first annular plate, the second annular plate, and the third annular plate, wherein the first annular plate, the second annular plate, and the third annular plate are arranged in parallel, the position of the through hole is corresponding to that of the via hole, the winding rack comprises a plurality of wire slots, and the wire slots are disposed on the tubular shell, and the primary winding is wound on at least one of the wire slots.

* * * * *